US012729503B2

(12) United States Patent
Harshman

(10) Patent No.: US 12,729,503 B2
(45) Date of Patent: Sep. 8, 2026

(54) CIRCLE ASSEMBLY FOR IMPLEMENT

(71) Applicant: Caterpillar Inc., Peoria, IL (US)

(72) Inventor: Nathaniel Keith Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 301 days.

(21) Appl. No.: 18/403,860

(22) Filed: Jan. 4, 2024

(65) Prior Publication Data

US 2025/0223777 A1 Jul. 10, 2025

(51) Int. Cl.
*E02F 3/76* (2006.01)

(52) U.S. Cl.
CPC ..... *E02F 3/764* (2013.01)

(58) Field of Classification Search
CPC ..... E02F 3/764
See application file for complete search history.

(56) References Cited

U.S. PATENT DOCUMENTS

| | | | | |
|---|---|---|---|---|
| 11,008,729 | B2 | 5/2021 | Ono et al. | |
| 11,274,416 | B2 | 3/2022 | Veasy et al. | |
| 11,447,927 | B2 * | 9/2022 | Harshman | E02F 3/764 |
| 2016/0208460 | A1 | 7/2016 | Kirsch | |
| 2017/0037595 | A1 | 2/2017 | Sharma | |
| 2021/0355653 | A1 * | 11/2021 | Reang | E02F 3/7645 |
| 2023/0235528 | A1 * | 7/2023 | Ma | E02F 3/764 172/792 |

* cited by examiner

*Primary Examiner* — Matthew R Buck

(57) ABSTRACT

A circle assembly for an implement of a motor grader includes a base plate defining a first slot and a second slot disposed adjacent to the first slot. The circle assembly also includes a circle fixedly coupled with the base plate and a first mounting bracket fixedly coupled to the base plate and the circle. The first mounting bracket defines a third slot. The circle assembly includes a first plate member fixedly coupled with the base plate and the first mounting bracket. The circle assembly also includes a second mounting bracket disposed adjacent to the first mounting bracket. The second mounting bracket is fixedly coupled to the base plate and the circle, wherein the second mounting bracket defines a fourth slot. The circle assembly further includes a second plate member fixedly coupled with the base plate and the second mounting bracket.

20 Claims, 8 Drawing Sheets

CIRCLE ASSEMBLY FOR IMPLEMENT

TECHNICAL FIELD

The present disclosure relates to a motor grader, an implement assembly for the motor grader, and a circle assembly for an implement of the motor grader.

BACKGROUND

Grading machines may be used in construction and maintenance of various surfaces, such as, roads. The grading machine may be used to cut, spread, and level materials, such as, soil, gravel, snow, and the like. To perform such earth sculpting tasks, grading machines include a blade, also referred to as a moldboard or an implement. The blade is supported and positioned on the grading machine by various components, including, a drawbar and a circle.

Further, a cylinder is disposed between the circle and the blade. The cylinder is coupled with the circle via a cantilevered cylinder mount assembly. The cylinder mount assembly on conventional grading machines may cause a bending of the circle. More particularly when immovable objects contact with the blade, the circle may undergo bending due to poor load distribution. The bending of the circle may increase downtime of the grading machine as well as replacement/servicing costs associated with the grading machine, which is not desirable.

U.S. Pat. No. 11,447,927 describes a grading machine that includes a machine body, a blade assembly, a circle supporting the blade assembly and including a plurality of teeth, a drawbar assembly connecting the circle to the machine body, and a cover plate coupled to a bottom portion of the drawbar assembly. The drawbar assembly includes a plurality of blocks, and the cover plate is configured to be coupled to the drawbar assembly via the plurality of blocks.

SUMMARY OF THE DISCLOSURE

In an aspect of the present disclosure, a circle assembly for an implement of a motor grader is provided. The circle assembly includes a base plate defining a first slot and a second slot disposed adjacent to the first slot. The circle assembly also includes a circle fixedly coupled with the base plate. The circle assembly further includes a first mounting bracket fixedly coupled to the base plate and the circle. The first mounting bracket defines a third slot. The circle assembly includes a first plate member fixedly coupled with the base plate and the first mounting bracket. The circle assembly also includes a second mounting bracket disposed adjacent to the first mounting bracket. The second mounting bracket is fixedly coupled to the base plate and the circle The second mounting bracket defines a fourth slot. The circle assembly further includes a second plate member fixedly coupled with the base plate and the second mounting bracket.

In another aspect of the present disclosure, an implement assembly for a motor grader is provided. The implement assembly includes a circle assembly. The circle assembly includes a base plate defining a first slot and a second slot disposed adjacent to the first slot. The circle assembly also includes a circle fixedly coupled with the base plate. The circle assembly further includes a first mounting bracket fixedly coupled to the base plate and the circle. The first mounting bracket defines a third slot. The circle assembly includes a first plate member fixedly coupled with the base plate and the first mounting bracket. The circle assembly also includes a second mounting bracket disposed adjacent to the first mounting bracket. The second mounting bracket is fixedly coupled to the base plate and the circle. The second mounting bracket defines a fourth slot. The circle assembly further includes second plate member fixedly coupled with the base plate and the second mounting bracket. The implement assembly also includes a blade removably coupled with the circle assembly. The implement assembly further includes a blade pitch cylinder coupled, at a first end, with the first mounting bracket and the second mounting bracket and coupled, at a second end, with the blade.

In yet another aspect of the present disclosure, a motor grader is provided. The motor grader includes a frame. The motor grader also includes a drawbar coupled to the frame. The motor grader further includes an implement assembly coupled with the drawbar. The implement assembly includes a circle assembly. The circle assembly includes a base plate defining a first slot and a second slot disposed adjacent to the first slot. The circle assembly also includes a circle fixedly coupled with the base plate. The circle assembly further includes a first mounting bracket fixedly coupled to the base plate and the circle. The first mounting bracket defines a third slot. The circle assembly includes a first plate member fixedly coupled with the base plate and the first mounting bracket. The circle assembly also includes a second mounting bracket disposed adjacent to the first mounting bracket. The second mounting bracket is fixedly coupled to the base plate and the circle. The second mounting bracket defines a fourth slot. The circle assembly further includes second plate member fixedly coupled with the base plate and the second mounting bracket. The implement assembly also includes a blade removably coupled with the circle assembly.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
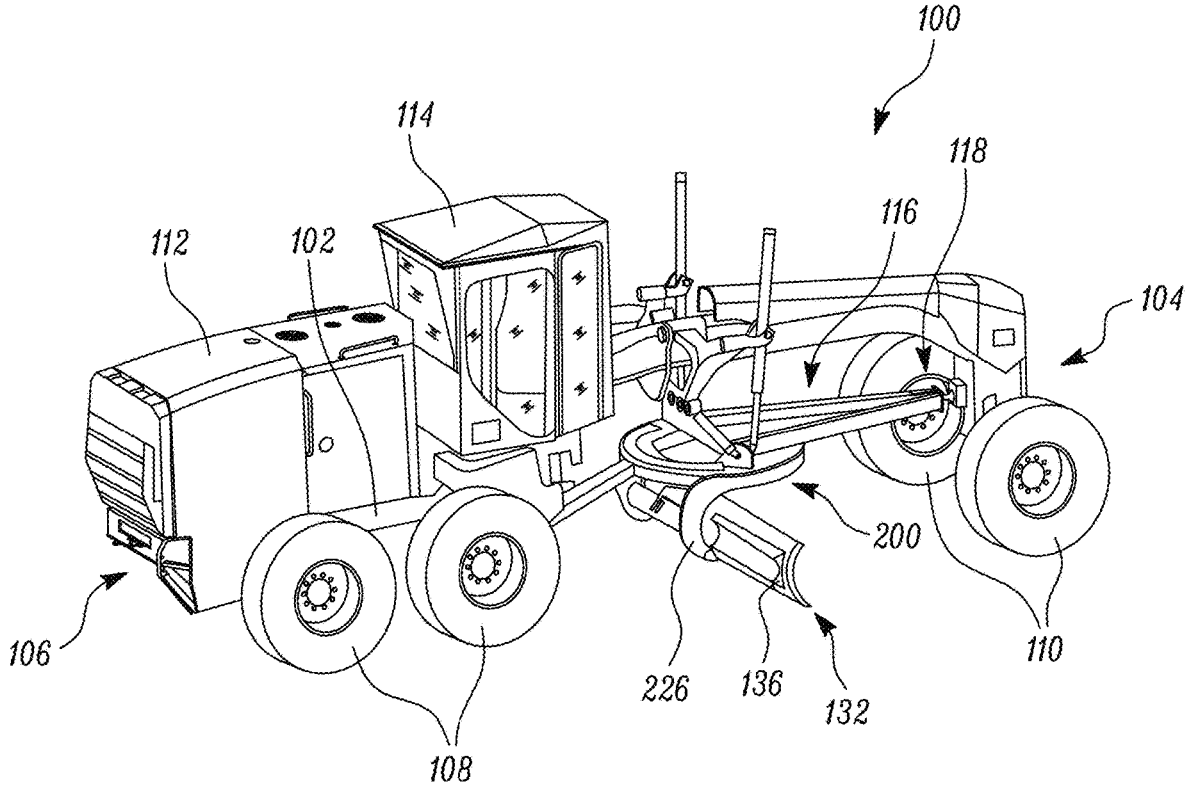
FIG. 1 is a schematic perspective view of a motor grader having an implement assembly, according to an example of the present disclosure.

Referring to FIG. 1, a perspective view of a motor grader 100 is illustrated. The motor grader 100 may operate on a ground surface to flatten uneven surfaces, such as, during a grading process prior to road construction, to cut/dig the ground surface, and/or for moving of snow, debris, and so on, without any limitations.

The motor grader 100 includes a frame 102. The frame 102 defines a front end 104 and a rear end 106. Further, the motor grader 100 includes two pairs of rear wheels 108 disposed proximate to the rear end 106 and one pair of front wheels 110 disposed proximate to the front end 104. The front wheels 110 and the rear wheels 108 allow movement of the motor grader 100 on the ground surface. The frame 102 supports various components of the motor grader 100, such as, a power source (not shown) disposed within an enclosure 112, an operator cabin 114, the front wheels 110, the rear wheels 108, and so on. The power source may be an engine, such as an internal combustion engine, a battery system, a fuel cell, and the like. The power source may supply output power to various components of the motor grader 100 for operation thereof.

Further, the motor grader 100 includes the operator cabin 114. An operator of the motor grader 100 may sit or stand in the operator cabin 114 for performing one or more operations. The motor grader 100 also includes a drawbar 116 coupled to the frame 102. The drawbar 116 is coupled to the frame 102 at an end 118 of the drawbar 116 by a ball and socket joint (not shown), such that the drawbar 116 can pivot relative to the frame 102.

Figure 2:
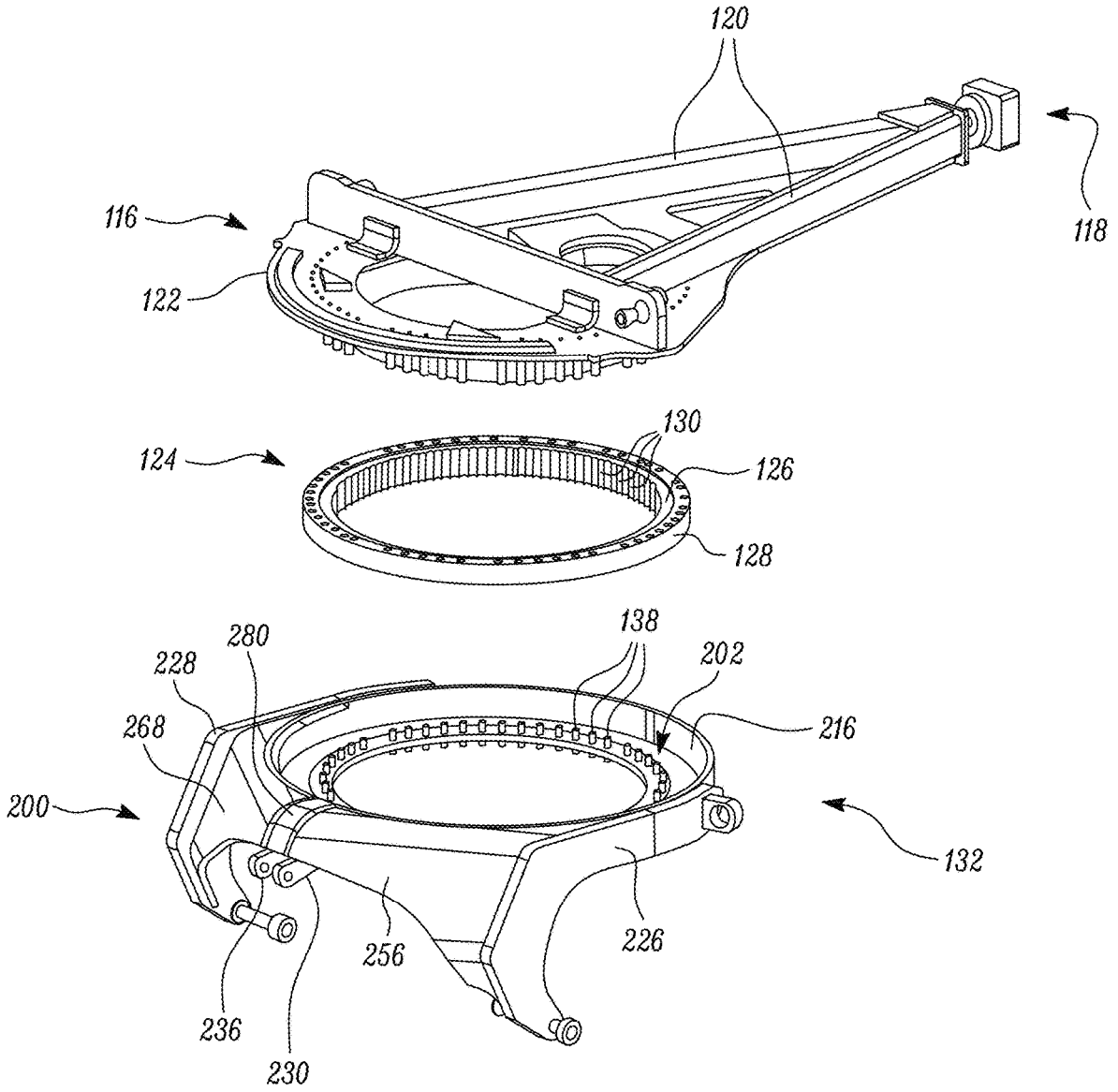
FIG. 2 is an exploded view of a drawbar and a circle assembly associated with the motor grader of FIG. 1, according to an example of the present disclosure.

Referring now to FIG. 2, the drawbar 116 includes one or more drawbar beams 120 and a circle mounting portion 122. In the illustrated example of FIG. 2, the drawbar 116 includes two drawbar beams 120, but it should be understood that the drawbar 116 can include any suitable number of drawbar beams 120, or any other suitable structure known to a person having ordinary skill in the art. The drawbar 116 may include additional elements (not shown herein) that may facilitate connection of the drawbar 116 to other components of the motor grader 100.

The motor grader 100 further includes a circle bearing 124. The circle bearing 124 may be replaced by any suitable bearing assembly. The circle bearing 124 includes an inner ring 126, an outer ring 128, and one or more rolling members (not shown) therebetween, such that the inner ring 126 and the outer ring 128 are rotatable relative to each other. The rolling members may be, ball bearings, roller bearings, magnets, any other suitable internal element for reducing friction, etc. Further, the outer ring 128 may be coupled to the circle mounting portion 122 by one or more fasteners (not shown herein). Furthermore, the inner ring 126 includes a number of teeth 130 that are engaged by drive members (not shown). The drive members are provided to rotate the circle assembly 200. The drive members may include a hydraulic motor and a gear arrangement, cylinders, cranks, gears, electric motors, fixed pin positions, or any other suitable mechanism.

The motor grader 100 further includes an implement assembly 132 coupled with the drawbar 116. The implement assembly 132 includes a circle assembly 200 for an implement 136 (shown in FIG. 1) of the motor grader 100. The implement 136 is a blade 136 herein. The implement 136 may be hereinafter interchangeably referred to as "blade 136". Specifically, the implement assembly 132 includes the blade 136 removably coupled with the circle assembly 200. The blade 136 may be used to perform work operations, such as, grading or snow removal. The implement assembly 132 further includes a blade pitch cylinder 134 (shown in FIG. 6) extending between the blade 136 and the circle assembly 200.

Figure 3:
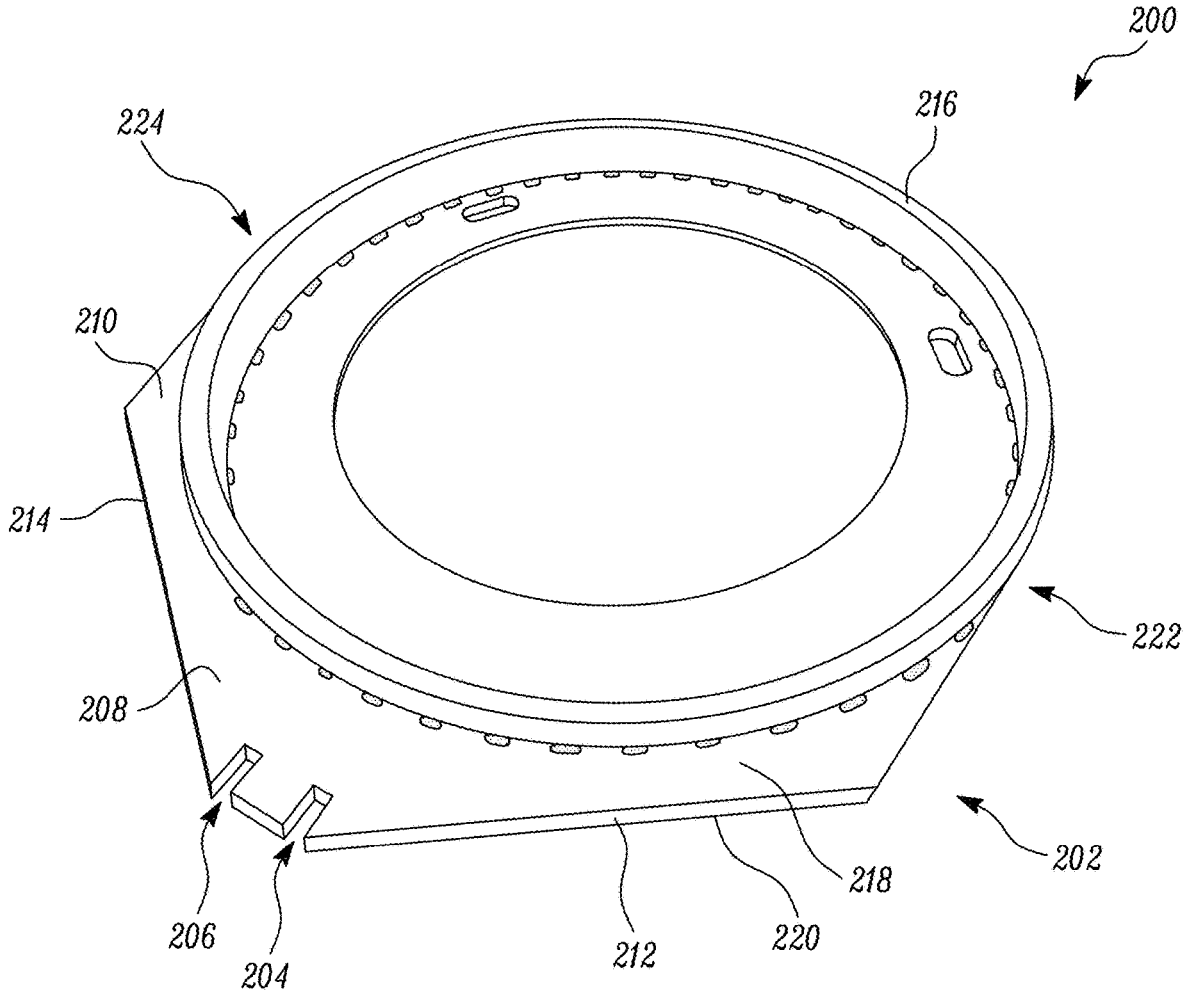
FIG. 3 is a top perspective view illustrating a circle and a base plate associated with the circle assembly of FIG. 2.

Referring to FIG. 3, the circle assembly 200 includes a base plate 202. The base plate 202 defines a first slot 204 and a second slot 206 disposed adjacent to the first slot 204. The base plate 202 defines a first portion 208 and a second portion 210 extending from the first portion 208. The first and second slots 204, 206 are defined in the first portion 208. Further, the base plate 202 includes a first side edge 212 and a second side edge 214. The first slot 204 extends from the first side edge 212 towards a circle 216 and the second slot 206 extends from the second side edge 214 towards the circle 216. The first and second side edges 212, 214 are defined in the first portion 208. Each of the first side edge 212 and the second side edge 214 includes a bevel profile. The base plate 202 defines a first surface 218 and a second surface 220 opposite the first surface 218. The base plate 202 defines a first end 222 and a second end 224. The first end 222 and the second end 224 are diametrically opposite of each other.

The circle assembly 200 also includes the circle 216 fixedly coupled with the base plate 202. The circle 216 may be continuous or the circle may be made from a number of arcuate portions that may be connected to each other by a joining process, such as, welding. The circle 216 is fixedly coupled to the first surface 218 of the base plate 202. In the illustrated example of FIG. 3, the circle 216 is fixedly coupled to the base plate 202 by welding.

It should be noted that the term "fixedly coupled" as used in this disclosure relates to direct coupling between two components. Further, the components of the circle assembly 200 are fixedly coupled to each other by welding. However, any other joining technique apart from welding may be used to fixedly couple the components of the circle assembly 200. It should be further noted that all welds have been marked by a separate hatching/gradient in the figures to differentiate them from components of the circle assembly 200. Moreover, the welds may be continuous welds, spot welds, and the like, without limiting the scope of the present disclosure.

Referring again to FIG. 2, the circle 216 is rotatably connected to the circle mounting portion 122 of the drawbar 116 by the circle bearing 124. The inner ring 126 is removably coupled to the circle 216 by one or more fasteners 138. The circle bearing 124 allows rotation of the circle 216 while preventing wear from engagement between the drive members and the circle assembly 200.

Further, the circle assembly 200 includes a first side bracket 226 fixedly coupled to the base plate 202 at the first end 222 of the base plate 202 and a second side bracket 228 fixedly coupled to the base plate 202 at the second end 224 of the base plate 202. Each of the first side bracket 226 and the second side bracket 228 are removably coupled to the blade 136 (see FIG. 1).

Figure 4A:
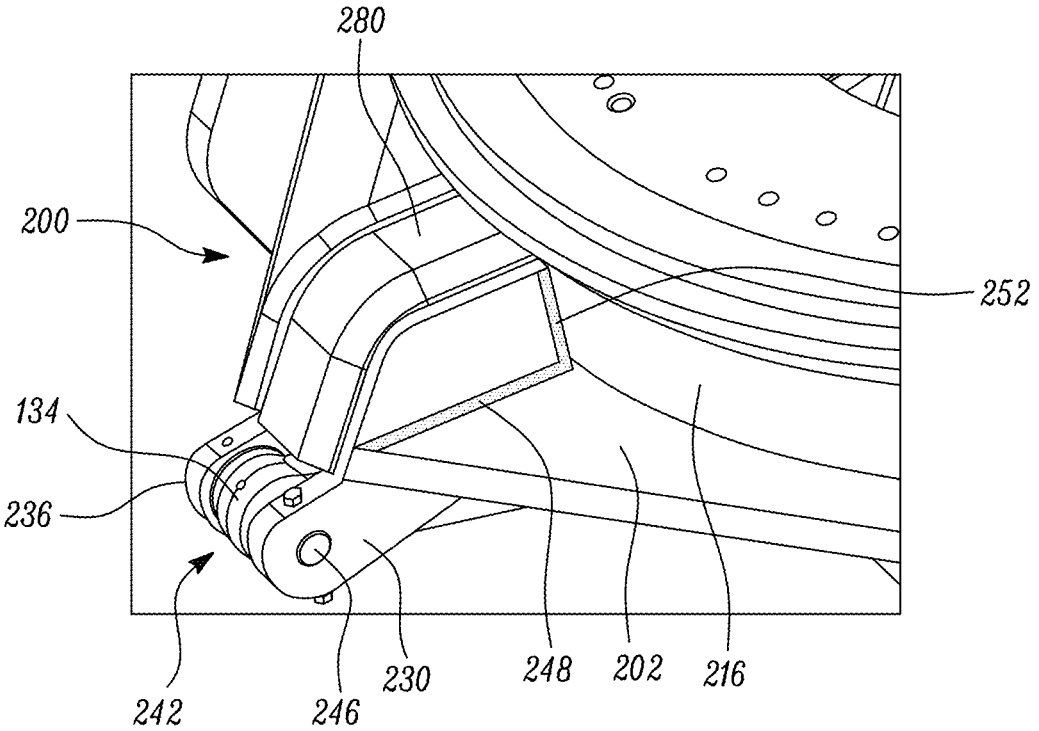
FIG. 4A is a perspective view illustrating a first mounting bracket and a second mounting bracket associated with the circle assembly of FIG. 2 coupled to the base plate and the circle.
Figure 4B:
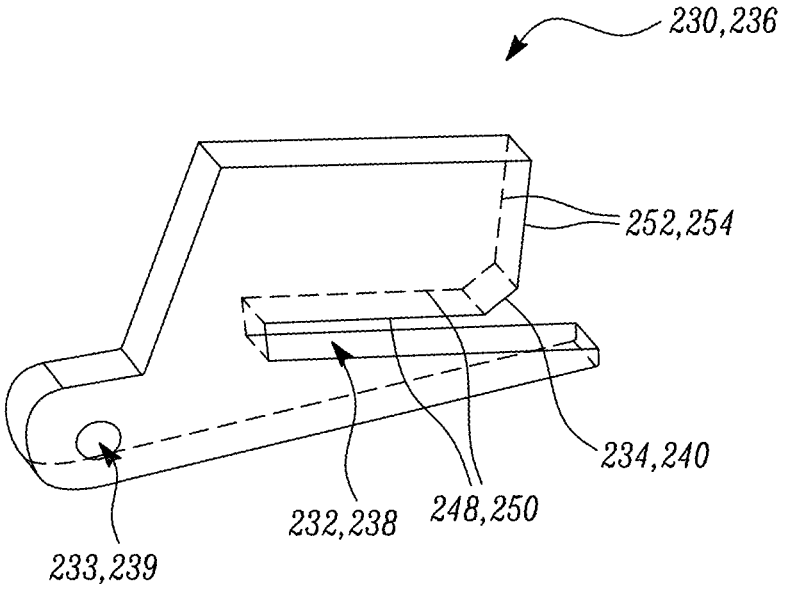
FIG. 4B is a perspective view illustrating the first mounting bracket and the second mounting bracket of FIG. 4A.

Referring now to FIGS. 4A and 4B, the circle assembly 200 also includes a first mounting bracket 230 fixedly coupled to the base plate 202 and the circle 216. The first mounting bracket 230 defines a third slot 232. The first slot 204 (see FIG. 2) of the base plate 202 and the third slot 232 of the first mounting bracket 230 interlock the base plate 202 and the first mounting bracket 230 with each other. In other words, the first slot 204 receives a portion of the first mounting bracket 230 therein, and the third slot 232 receives a portion of the base plate 202 therein. The first mounting bracket 230 includes a chamfered surface 234. The first mounting bracket 230 defines a first opening 233.

The circle assembly 200 further includes a second mounting bracket 236 disposed adjacent to the first mounting bracket 230. The first and second mounting brackets 230, 236 are identical in design and dimensions. The second mounting bracket 236 is fixedly coupled to the base plate 202 and the circle 216. The second mounting bracket 236 defines a fourth slot 238. Further, the second slot 206 (see FIG. 2) of the base plate 202 and the fourth slot 238 of the second mounting bracket 236 interlock the base plate 202 and the second mounting bracket 236 with each other. In other words, the second slot 206 receives a portion of the second mounting bracket 236 therein, and the fourth slot 238 receives a portion of the base plate 202 therein. The second mounting bracket 236 includes a chamfered surface 240. The second mounting bracket 236 defines a second opening 239.

As shown in FIG. 4A, the blade pitch cylinder 134 is coupled, at a first end 242, with the first mounting bracket 230 and the second mounting bracket 236 and coupled, at a second end 244 (shown in FIG. 6), with the blade 136 (see FIG. 1). Specifically, the first and second mounting brackets 230, 236 are removably coupled to the first end 242 of the blade pitch cylinder 134, via a fastener 246. The first opening 233 (see FIG. 4B), the second opening 239 (see FIG. 4B), and an opening defined by the blade pitch cylinder 134 are in alignment with each other to receive the fastener 246. The first mounting bracket 230 is fixedly coupled to the base plate 202 along an edge 248 by welding. Further, the second mounting bracket 236 is fixedly coupled to the base plate 202 along an edge 250 (see FIGS. 4B and 5) by welding.

Figure 5:
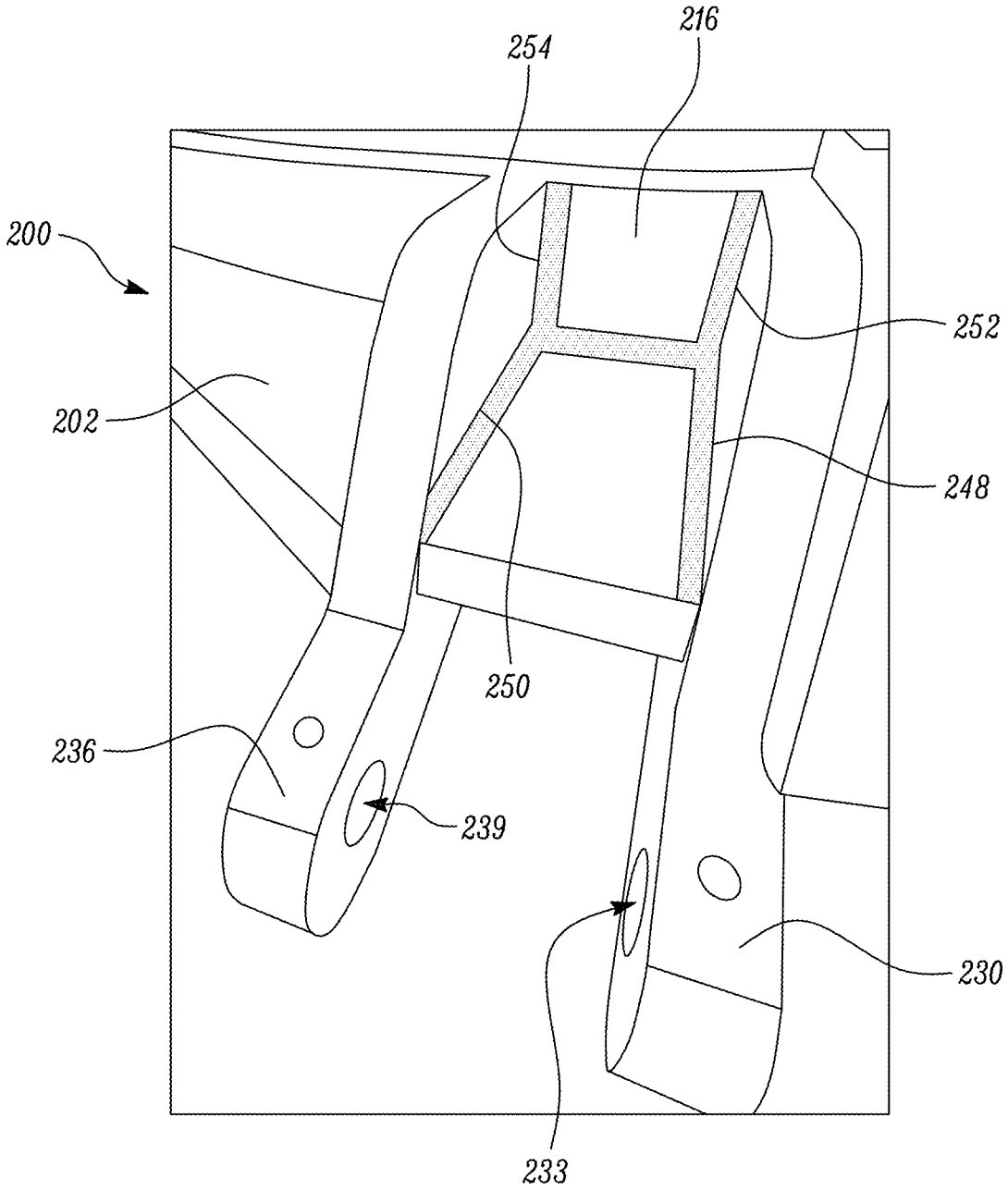
FIG. 5 is a perspective view illustrating the first mounting bracket and the second mounting bracket coupled to the base plate and the circle.

As shown in FIG. 5, the first mounting bracket 230 is fixedly coupled to the base plate 202 along an edge 252 by welding. Further, the second mounting bracket 236 is fixedly coupled to the base plate 202 along an edge 254 (see FIGS. 4B and 5) by welding.

Figure 6:
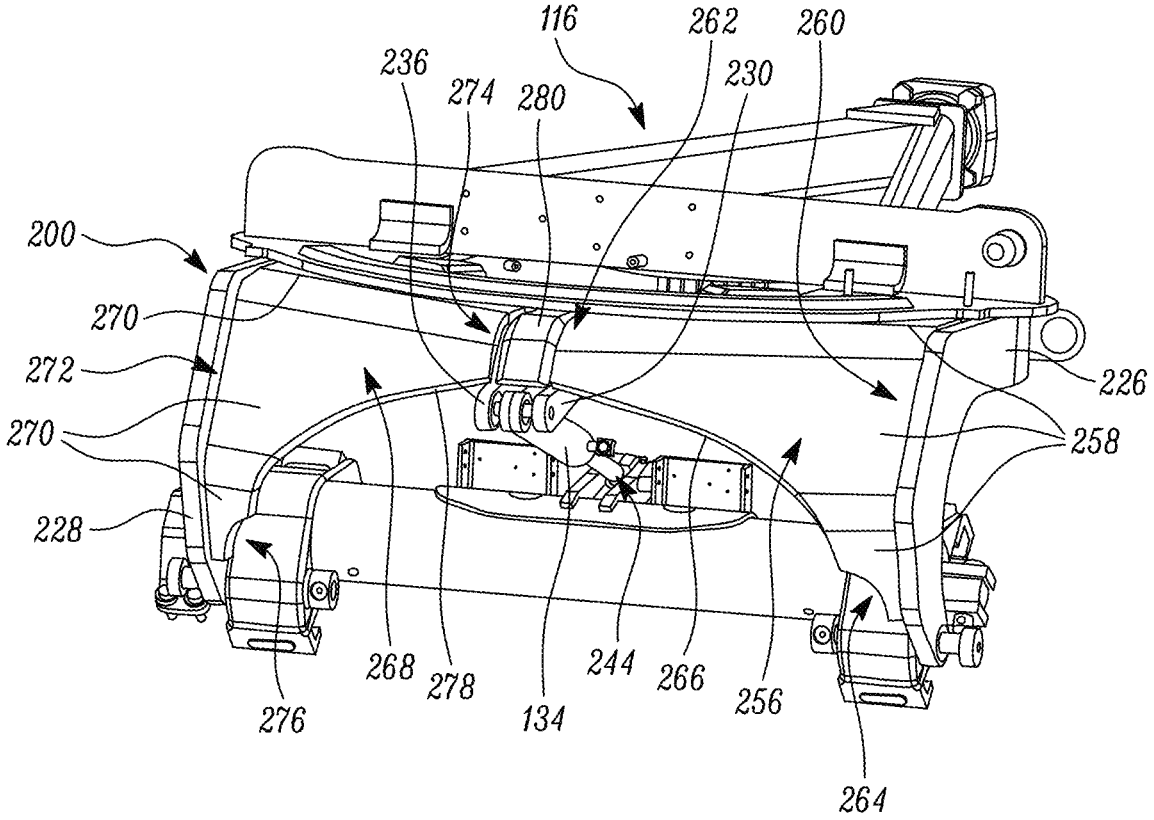
FIG. 6 is a front perspective view of the circle assembly of FIG. 2.

Referring now to FIG. 6, the circle assembly 200 includes a first plate member 256 fixedly coupled with the base plate 202 and the first mounting bracket 230. The first plate member 256 has a number of angled portions 258. Specifically, the first plate member 256 has three angled portions 258 that are angularly disposed relative to each other. The first plate member 256 defines a first side 260 and a second side 262. The first plate member 256 is fixedly coupled with the first mounting bracket 230 by welding at the second side 262. The first plate member 256 defines a first cut-out 264 proximal to the first side bracket 226. Specifically, the first cut-out 264 is proximal to the first side 260. The first cut-out 264 is arcuate in shape. Moreover, the first plate member 256 includes an arcuate surface 266 extending from the first side 260 to the second side 262.

The circle assembly 200 also includes a second plate member 268 fixedly coupled with the base plate 202 and the second mounting bracket 236. The second plate member 268 has a number of angled portions 270. Specifically, the second plate member 268 has three angled portions 270 that are angularly disposed relative to each other. The second plate member 268 defines a third side 272 and a fourth side 274. The second plate member 268 is fixedly coupled with the second mounting bracket 236 by welding at the fourth side 274. The second plate member 268 defines a second cut-out 276 proximal to the second side bracket 228. Specifically, the second cut-out 276 is proximal to the third side 272. The second cut-out 276 is arcuate in shape. Moreover, the second plate member 268 includes an arcuate surface 278 extending from the third side 272 to the fourth side 274.

Figure 7:
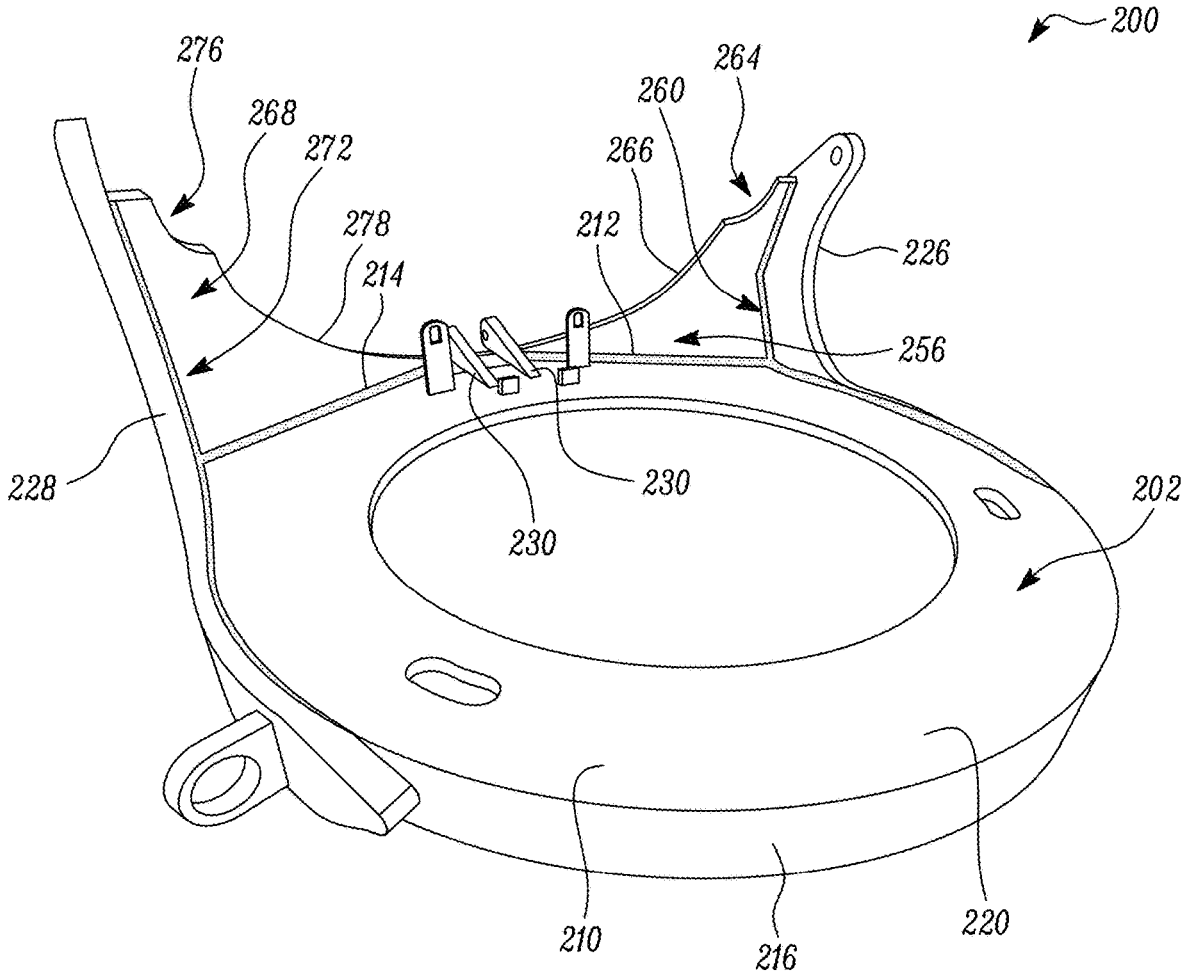
FIG. 7 is a bottom perspective view illustrating a first plate member and a second plate member associated with the circle assembly of FIG. 2.

Referring to FIG. 7, the first plate member 256 is fixedly coupled to the first side bracket 226 and the second plate member 268 is fixedly coupled to the second side bracket 228. Specifically, the first plate member 256 is welded to the first side bracket 226 at the first side 260 and the second plate member 268 is welded to the second side bracket 228 at the third side 272. Further, the first plate member 256 is fixedly coupled to the first side edge 212 of the base plate 202. Specifically, the first plate member 256 is welded to the base plate 202 along the first side edge 212. Furthermore, the second plate member 268 is fixedly coupled to the second side edge 214 of the base plate 202. Specifically, the second plate member 268 is welded to the base plate 202 along the second side edge 214.

Figure 8A:
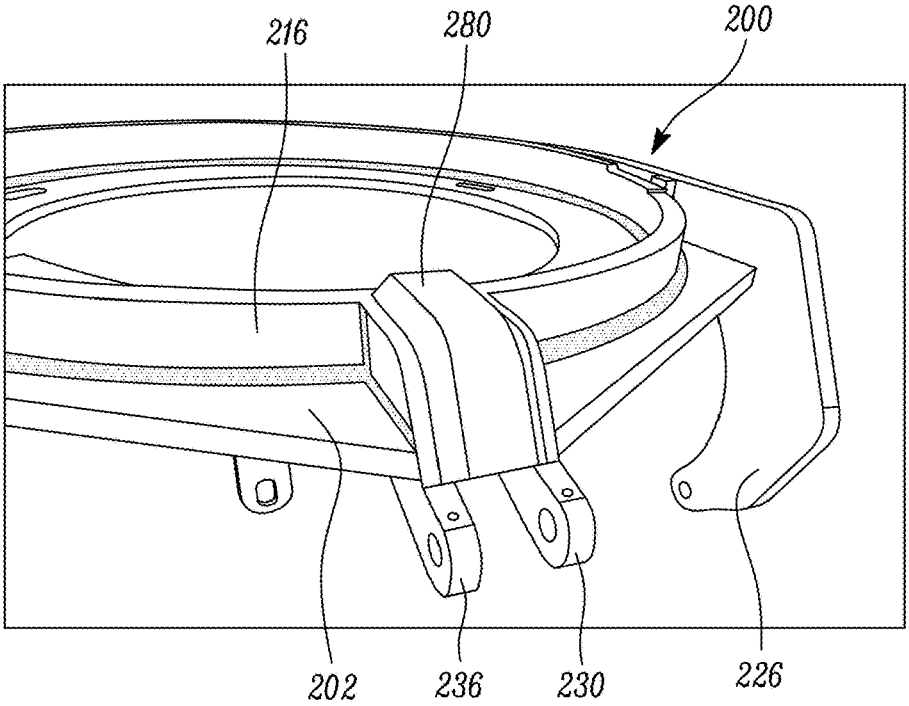
FIGS. 8A and 8B are perspective views illustrating a central plate associated with the circle assembly of FIG. 2.

As shown in FIG. 8A, the circle assembly 200 also includes a central plate 280 extending between the first mounting bracket 230 and the second mounting bracket 236. The central plate 280 has an angled profile. The central plate 280 is illustrated in FIG. 8A in an uncoupled state.

Figure 8B:
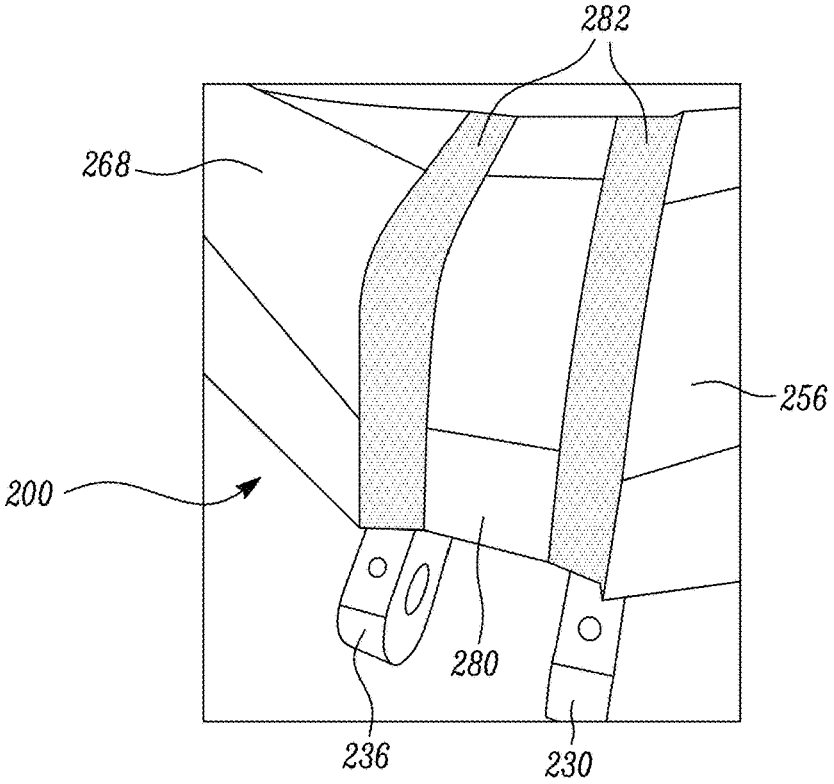

Referring to FIG. 8B, the central plate 280 is fixedly coupled to each of the circle 216, the first plate member 256, and the second plate member 268. Specifically, the welding material 282 on either side of the central plate 280 as shown in FIG. 8B couples the central plate 280 to each of the first mounting bracket 230, the second mounting bracket 236, the circle 216, the first plate member 256, and the second plate member 268.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the circle assembly 200 for the motor grader 100. The circle assembly 200 includes the first and second mounting brackets 230, 236 that facilitate coupling of the blade pitch cylinder 134 with the circle 216. The first and second mounting brackets 230, 236 include the third and fourth slots 232, 238, respectively that allow connection of the first and second mounting brackets 230, 236 with the base plate 202. The third and fourth slots 232, 238 interlock with the first and second slots 204, 206 in the base plate 202. Moreover, a portion of the first and second mounting brackets 230, 236 is retained within the first and second slots 204, 206, respectively of the base plate 202. The third and fourth slots 232, 238 may also aid in assembly of the first and second mounting brackets 230, 236 with the base plate 202.

Further, the first and second mounting brackets 230, 236 may facilitate distribution of cylinder loads across the circle assembly 200, thereby preventing bending of the circle assembly 200, and more particularly, the bending of the circle 216. Furthermore, the first and second mounting brackets 230, 236 are welded to the base plate 202 and the circle 216 to transfer and distribute cylinder loads optimally across the circle assembly 200.

The circle assembly 200 also includes the first plate member 256, the second plate member 268, and the central plate 280. Moreover, the first and second cut-outs 264, 276 in the respective first and second plate members 256, 268 may allow uniform distribution of cylinder loads across the respective first and second plate members 256, 268. Thus, the circle assembly 200 described herein may prevent bending of the circle 216, which may in turn reduce any downtime associated with the motor grader 100 and may also reduce servicing/maintenance costs of the motor grader 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A circle assembly for an implement of a motor grader, the circle assembly comprising:

a base plate defining a first slot and a second slot disposed adjacent to the first slot;

a circle fixedly coupled with the base plate;

a first mounting bracket fixedly coupled to the base plate and the circle, wherein the first mounting bracket defines a third slot;

a first plate member fixedly coupled with the base plate and the first mounting bracket;

a second mounting bracket disposed adjacent to the first mounting bracket, the second mounting bracket being fixedly coupled to the base plate and the circle, wherein the second mounting bracket defines a fourth slot; and a second plate member fixedly coupled with the base plate and the second mounting bracket;

wherein the first slot of the base plate and the third slot of the first mounting bracket interlock the base plate and the first mounting bracket with each other, and wherein the second slot of the base plate and the fourth slot of the second mounting bracket interlock the base plate and the second mounting bracket with each other.

2. The circle assembly of claim 1, further comprising a central plate extending between the first mounting bracket and the second mounting bracket, wherein the central plate is fixedly coupled to each of the circle, the first plate member, and the second plate member.

3. The circle assembly of claim 1, further comprising a first side bracket fixedly coupled to the base plate at a first end of the base plate and a second side bracket fixedly coupled to the base plate at a second end of the base plate, wherein the first end and the second end are diametrically opposite of each other, and wherein the first plate member is fixedly coupled to the first side bracket and the second plate member is fixedly coupled to the second side bracket.

4. The circle assembly of claim 3, wherein the first plate member defines a first cut-out proximal to the first side bracket, and wherein the second plate member defines a second cut-out proximal to the second side bracket.

5. The circle assembly of claim 1, wherein the base plate includes a first side edge and a second side edge, wherein the first slot extends from the first side edge towards the circle and the second slot extends from the second side edge towards the circle, and wherein each of the first side edge and the second side edge includes a bevel profile.

6. The circle assembly of claim 5, wherein the first plate member is fixedly coupled to the first side edge of the base plate, and wherein the second plate member is fixedly coupled to the second side edge of the base plate.

7. An implement assembly for a motor grader, the implement assembly comprising:

a circle assembly including:

a base plate defining a first slot and a second slot disposed adjacent to the first slot;

a circle fixedly coupled with the base plate;

a first mounting bracket fixedly coupled to the base plate and the circle, wherein the first mounting bracket defines a third slot;

a first plate member fixedly coupled with the base plate and the first mounting bracket;

a second mounting bracket disposed adjacent to the first mounting bracket, the second mounting bracket being fixedly coupled to the base plate and the circle, wherein the second mounting bracket defines a fourth slot; and a second plate member fixedly coupled with the base plate and the second mounting bracket;

a blade removably coupled with the circle assembly; and a blade pitch cylinder coupled, at a first end, with the first mounting bracket and the second mounting bracket and coupled, at a second end, with the blade;

wherein the first slot of the base plate and the third slot of the first mounting bracket interlock the base plate and the first mounting bracket with each other, and wherein the second slot of the base plate and the fourth slot of the second mounting bracket interlock the base plate and the second mounting bracket with each other.

8. The implement assembly of claim 7, wherein the circle assembly further includes a central plate extending between the first mounting bracket and the second mounting bracket, wherein the central plate is fixedly coupled to each of the circle, the first plate member, and the second plate member.

9. The implement assembly of claim 7, wherein the circle assembly further includes a first side bracket fixedly coupled to the base plate at a first end of the base plate and a second side bracket fixedly coupled to the base plate at a second end of the base plate, wherein the first end and the second end are diametrically opposite of each other, and wherein the first plate member is fixedly coupled to the first side bracket and the second plate member is fixedly coupled to the second side bracket.

10. The implement assembly of claim 7, wherein the circle assembly further includes a first side bracket fixedly coupled to the base plate at a first end of the base plate and a second side bracket fixedly coupled to the base plate at a second end of the base plate, and wherein the blade is removably coupled with the circle assembly via the first side bracket, the second side bracket, and the blade pitch cylinder.

11. The implement assembly of claim 7, wherein the base plate includes a first side edge and a second side edge, wherein the first slot extends from the first side edge towards the circle and the second slot extends from the second side edge towards the circle, and wherein each of the first side edge and the second side edge includes a bevel profile.

12. The implement assembly of claim 11, wherein the first plate member is fixedly coupled to the first side edge of the base plate, and wherein the second plate member is fixedly coupled to the second side edge of the base plate.

13. A motor grader comprising:

a frame; and a drawbar coupled to the frame;

an implement assembly coupled with the drawbar, the implement assembly including:

a circle assembly including:

a base plate defining a first slot and a second slot disposed adjacent to the first slot;

a circle fixedly coupled with the base plate;

a first mounting bracket fixedly coupled to the base plate and the circle, wherein the first mounting bracket defines a third slot;

a first plate member fixedly coupled with the base plate and the first mounting bracket;

a second mounting bracket disposed adjacent to the first mounting bracket, the second mounting bracket being fixedly coupled to the base plate and the circle, wherein the second mounting bracket defines a fourth slot; and a second plate member fixedly coupled with the base plate and the second mounting bracket; and a blade removably coupled with the circle assembly;

wherein the first slot of the base plate and the third slot of the first mounting bracket interlock the base plate and the first mounting bracket with each other, and wherein the second slot of the base plate and the fourth slot of the second mounting bracket interlock the base plate and the second mounting bracket with each other.

14. The motor grader of claim 13, wherein the circle assembly further includes a central plate extending between the first mounting bracket and the second mounting bracket, wherein the central plate is fixedly coupled to each of the circle, the first plate member, and the second plate member.

15. The motor grader of claim 13, wherein the circle assembly further includes a first side bracket fixedly coupled to the base plate at a first end of the base plate and a second side bracket fixedly coupled to the base plate at a second end of the base plate, wherein the first end and the second end are diametrically opposite of each other, wherein each of the first side bracket and the second side bracket are removably coupled to the blade, and wherein the first plate member is fixedly coupled to the first side bracket and the second plate member is fixedly coupled to the second side bracket.

16. The motor grader of claim 13, wherein the base plate includes a first side edge and a second side edge, wherein the first slot extends from the first side edge towards the circle and the second slot extends from the second side edge towards the circle, and wherein each of the first side edge and the second side edge includes a bevel profile.

17. The motor grader of claim 16, wherein the first plate member is fixedly coupled to the first side edge of the base plate, and wherein the second plate member is fixedly coupled to the second side edge of the base plate.

18. A circle assembly for an implement of a motor grader, the circle assembly comprising:

a base plate defining a first slot and a second slot disposed adjacent to the first slot;

a circle fixedly coupled with the base plate;

a first mounting bracket fixedly coupled to the base plate and the circle, wherein the first mounting bracket defines a third slot;

a first plate member fixedly coupled with the base plate and the first mounting bracket;

a second mounting bracket disposed adjacent to the first mounting bracket, the second mounting bracket being fixedly coupled to the base plate and the circle, wherein the second mounting bracket defines a fourth slot; and a second plate member fixedly coupled with the base plate and the second mounting bracket;

wherein the base plate includes a first side edge and a second side edge, wherein the first slot extends from the first side edge towards the circle and the second slot extends from the second side edge towards the circle.

19. The circle assembly of claim 18, further comprising a central plate extending between the first mounting bracket and the second mounting bracket, wherein the central plate is fixedly coupled to each of the circle, the first plate member, and the second plate member.

20. The circle assembly of claim 18, further comprising a first side bracket fixedly coupled to the base plate at a first end of the base plate and a second side bracket fixedly coupled to the base plate at a second end of the base plate, wherein the first end and the second end are diametrically opposite of each other, and wherein the first plate member is fixedly coupled to the first side bracket and the second plate member is fixedly coupled to the second side bracket.

* * * * *